United States Patent [19]

Yanagawa

[11] 4,061,330

[45] Dec. 6, 1977

[54] SHEET SEPARATOR FOR USE IN ELECTROPHOTOGRAPHIC COPYING MACHINES

[75] Inventor: Nobuyuki Yanagawa, Chigasaki, Japan

[73] Assignee: Ricoh Co., Ltd., Tokyo, Japan

[21] Appl. No.: 712,714

[22] Filed: Aug. 9, 1976

[30] Foreign Application Priority Data

Aug. 9, 1975 Japan ..... 50-97025

[51] Int. Cl.[2] ..... B65H 29/54

[52] U.S. Cl. ..... 271/174; 271/DIG. 2; 271/107

[58] Field of Search ..... 270/DIG. 2, 80, 107, 270/174; 355/3 R

[56] References Cited

U.S. PATENT DOCUMENTS 3,774,907 11/1973 Borostyan ..... 271/DIG. 2 X 3,867,026 2/1975 Ogawa ..... 271/DIG. 2 X

*Primary Examiner*—Robert W. Saifer

*Attorney, Agent, or Firm*—Cooper, Dunham, Clark, Griffin & Moran

[57] ABSTRACT

A sheet separator separates a copy sheet held attracted to the surface of a rotating photosensitive member by the use of a suction member pivotably disposed at a sheet separating position. The suction member includes an air suction port in its surface which is located opposite the photosensitive member. During a movement of the suction port from a first position in which it is located rearwardly, as viewed in the direction of movement of the photosensitive member, of a line joining the axis of rotation of the photosensitive member and the pivotal axis of the suction member to a second position forwardly of the line, the suction member holds the leading edge of the copy sheet attracted thereto, thereby separating it from the photosensitive member.

6 Claims, 4 Drawing Figures

SHEET SEPARATOR FOR USE IN ELECTROPHOTOGRAPHIC COPYING MACHINES

BACKGROUND OF THE INVENTION

The present invention relates to a sheet separator for use in electrophotographic copying machines, and more particularly, to such an apparatus which separates a copy sheet as held attracted to the surface of a rotating photosensitive member of the machine from said surface.

In electrophotographic copying machines, an electrostatic latent image or a toner image thereof is transferred onto a copy sheet by an arrangement which brings the surface of the photosensitive member which carries the image into contact with the copy sheet. When brought into contact with the photosensitive member, the copy sheet is held attracted to the surface under the influence of an electric charge which is present thereon. The electrostatic latent image is formed by exposing a uniformly charged surface of the photosensitive member to a light image of an original being copied. Where the copying machine is of the type utilizing a transfer of latent image, the latent image formed is transferred onto a copy sheet, and the tranferred image on the latter is converted into a visual image by using either a toner containing developing solution or a dry developer. However, if the copying machine is of the type utilizing a transfer of visual image, the latent image formed on the surface of the photosensitive member is developed before it is transferred onto the copy sheet.

Several arrangements are known which may be used to separate a copy sheet from the photosensitive member when it is held attracted thereto. In one form, claws are maintained in gentle abutting relationship with the surface of the photosensitive member so that the leading edge of the copy sheet may be stripped off the surface as it comes to engage the claws. This however suffers from the likelihood of damaging or impairing the surface of the photosensitive member.

In another form of sheet separator, a jet of air is directed toward the leading edge of the copy sheet in a direction opposite to the direction of rotation of the photosensitive member so as to deflect the edge and the sheet away from the surface of the member. However, an air spray of a high pressure must be provided in order to separate the copy sheet which is held attracted to the photosensitive member.

SUMMARY OF THE INVENTION

It is an object of the present invention to provide a sheet separator which eliminates the disadvantages of the prior art.

It is another object of the invention to provide a sheet separator including a suction member which applies a suction to the rear surface of the leading end of a copy sheet held attracted to the photosensitive member, and which suction member is subsequently diverted into a direction in which it moves the leading end of the sheet away from the photosensitive member, thereby achieving a reliable sheet separation.

It is a further object of the invention to provide an apparatus which supplies an air injection into the clearance between the photosensitive member and the leading end of a copy sheet as separated therefrom by the action of a suction member, thereby assuring a sheet separation.

Further objects of the invention will become apparent from a reading of the description of an embodiment thereof taken together with the illustration in the drawings.

DETAILED DESCRIPTION OF PREFERRED EMBODIMENT

Figure 1:
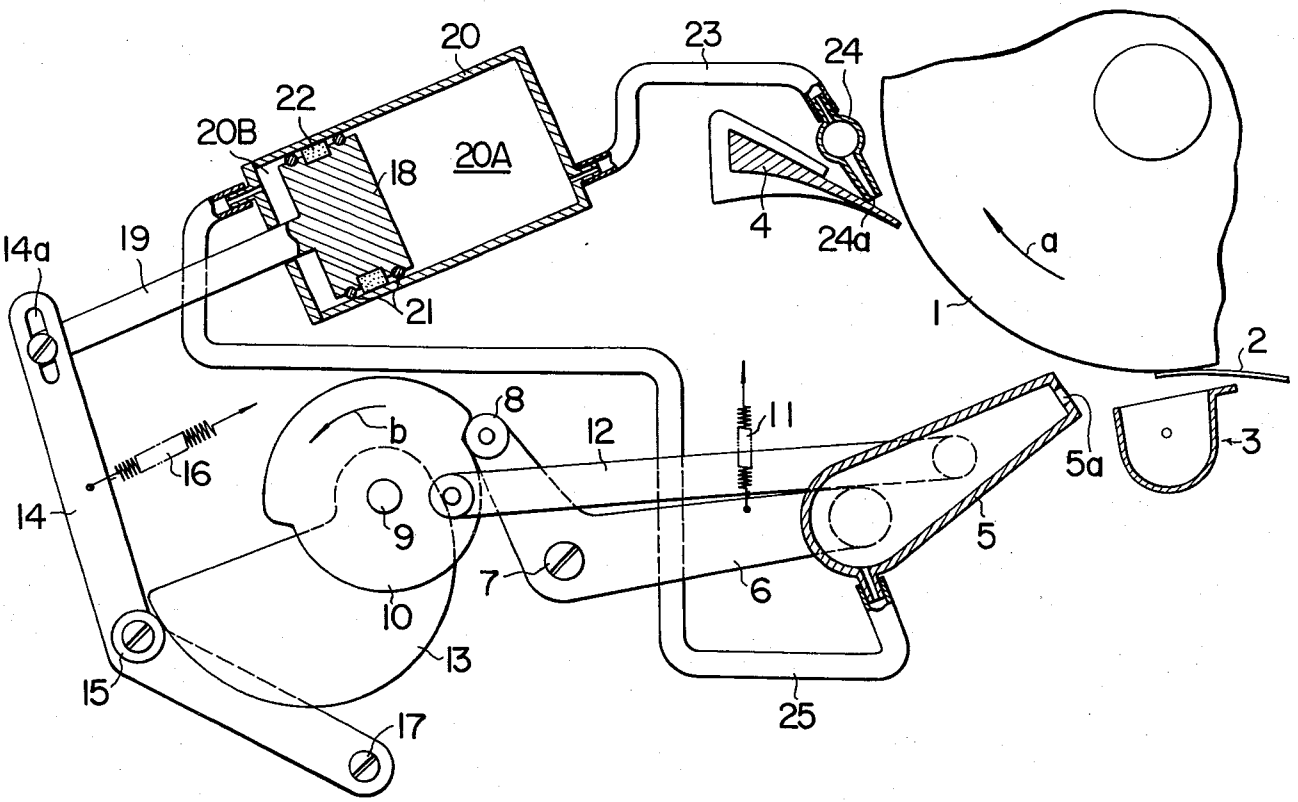
FIG. 1 is a side elevation, partly in section, of a sheet separator constructed in accordance with one embodiment of the invention.

Referring to FIG. 1, there is shown part of a photosensitive member in the form of a rotating drum 1. A toner image is formed on the peripheral surface of the drum 1 by a well known electrophotographic process. A transfer sheet 2 is fed by a sheet feeder, not shown, to the surface area of the drum 1 carrying the toner image for movement therewith in a direction indicated by an arrow *a*. A transfer station formed by a corona discharger 3 located opposite to the drum causes the toner image to be transferred from the drum surface onto the opposing surface of the sheet 2.

Disposed downstream of the discharger 3 along the path of movement of the sheet 2 and in opposing relationship with the drum surface is a guideplate 4 which guides the sheet 2 now carrying the toner image into a secondary treatment station such as a toner image fixing unit.

Figure 3:
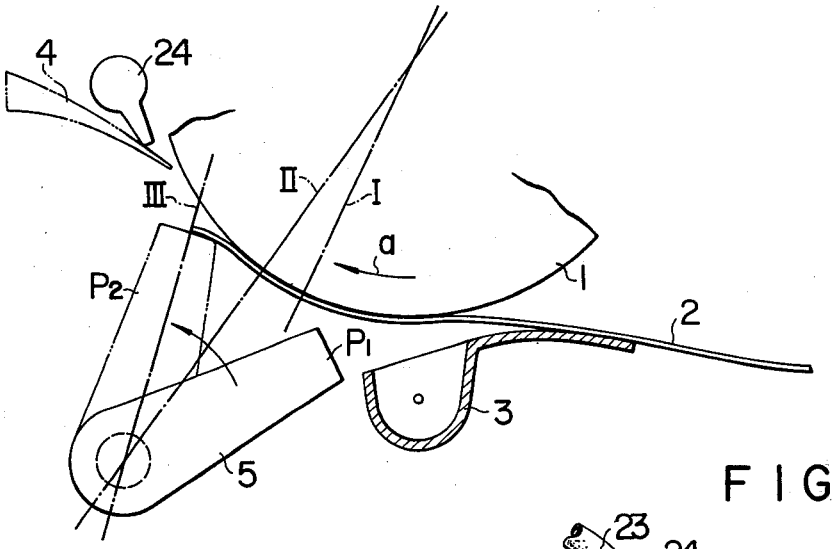
FIG. 3 is a side elevation showing the suction member at the commencement of its operation as the leading end of the copy sheet reaches the separating position.

In the region between the discharger 3 and the guideplate 4 where the sheet 2 is to be separated from the drum, a suction member 5 which comprises a hollow body is disposed extending along the generatrix of the drum 1. The suction member 5 is rockably mounted on a support shaft extending parallel to the axis of rotation of the drum and which is mounted on the free ends of a pair of arms 6 (only one being shown). In its end face located nearer the drum 1, suction member 5 is formed with an air suction inlet 5*a*. As shown in FIG. 3, the suction member 5 is pivotally movable between a first position P1 located rearwardly, as viewed in the direction of rotation of the drum, of a line II joining the axis of rotation of the drum and the support shaft of the member 5, and a second position P2 located forwardly of the line.

The arms 6 are pivotally mounted on a stud 7, and pivotally carry a roller 8 on their opposite end, which bears against the cam profile of a first cam 10, fixedly mounted on a rotating shaft 9 for integral rotation therewith. A tension spring 11 engaging the arms 6 urges the roller resiliently against the cam 10. The shaft 9 is adapted to rotate the first cam 10 through one revolution in a direction indicated by an arrow *b* by being connected with a continuously rotating shaft, not shown, through a single revolution clutch of known form. One end of a lever 12 is pivotally connected with the side of the first cam 10 at a point offset from the axis of rotation thereof, and the other end of the lever 12 is similarly pivotally connected with the side of the suction member 5 at a point offset from the axis of pivotal motion thereof.

A second cam 13 is fixedly mounted on the shaft 9 in the similar manner as the first cam 10 and has a cam profile, against which a roller 15 mounted on an arm 14 bears under the resilience of a tension spring 16. The arm 14 is pivotally mounted on a stud 17, and an elongate slot 14*a* is formed in its free end for receiving one end of a piston rod 19, whose other end is integral with a piston 18 slidably received in a closed cylinder 20. A pair of O-rings 21 and a center ring 22 of oil containing material such as polyurethane foam (tradename) are embedded in the outer surface of piston 18 so as to bear against the inner surface of the cylinder 20, thereby preventing a displacement of air from a first chamber 20A to a second chamber 20B formed in the cylinder 20. The first chamber 20A communicates through a piping 23 with an air discharge nozzle 24 having a discharge port 24*a*, while the second chamber 20B communicates through a piping 25 with the hollow interior of member 5 and hence the air suction inlet 5*a*.

Figure 2:
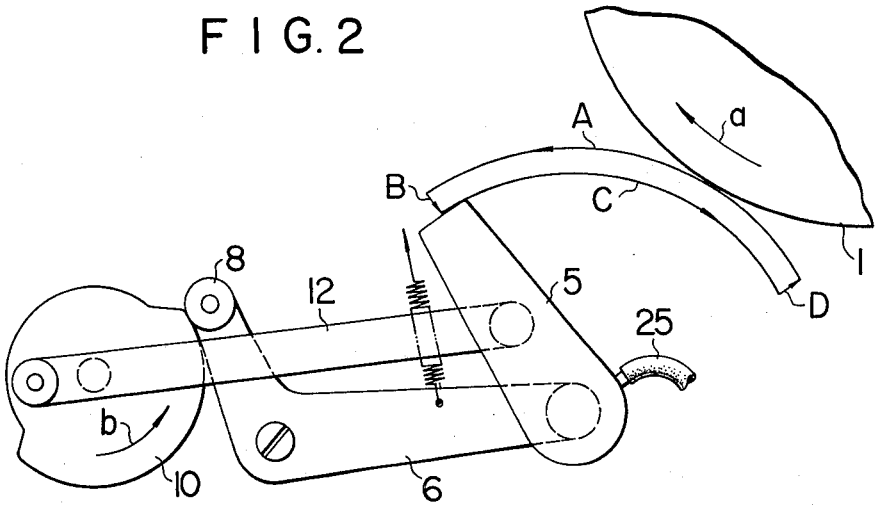
FIG. 2 is a side elevation of drive means for the suction member shown in FIG. 1, illustrating the motion thereof.
Figure 4:
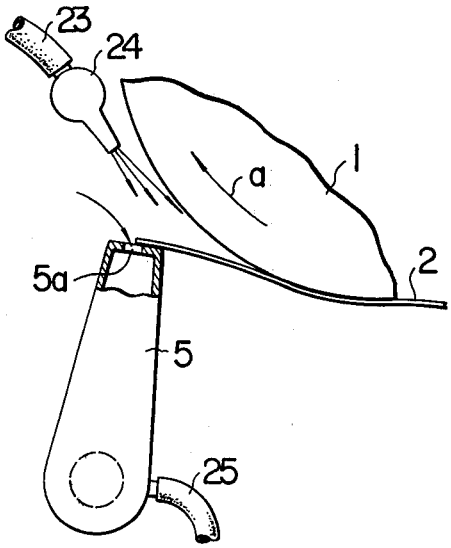
FIG. 4 is a side elevation of the suction member at the termination of its operation, showing the leading end of the copy sheet removed from the photosensitive member.

When the sheet 2 moves in the direction of the arrow *a* together with the drum 1 and its leading edge reaches a position indicated by a phantom line I in FIG. 3, a sheet detector such as a microswitch having its actuator extending into the path of the sheet or a photosensor is activated to turn on the single revolution clutch mentioned above. Thereupon, the shaft 9 is set in motion, causing a rotation of the first cam 10 and the second cam 13 integrally therewith. The rotation of the first cam 10 causes the suction member 5, through lever 12, to rock from the first position P1 to the second position P2, moving the air suction inlet 5*a* along a path indicated by a line A shown in FIG. 2 at a velocity which exceeds that of the sheet 2. As the member 5 rocks to a position aligned with the phantom line II, the air suction inlet 5*a* becomes aligned with the leading end of the sheet 2. When the inlet 5*a* is aligned with the phantom line II, it is located close enough to the drum surface to gently rub against the sheet. Immediately before this occurs, the second cam 13 has rotated sufficiently to cause a large diameter portion thereof to be disengaged from the roller 15, whereby the arm 14 rotates clockwise, as viewed in FIG. 1, under the resilience of the spring 16. As the arm 14 rotates, the piston 18 is shifted from left to right within the cylinder 20, thus reducing the pressure in the second chamber 20B of the cylinder 20. The resulting vacuum acts through the piping 25 to draw the atmosphere through the inlet 5*a* of the suction member, thereby attracting and holding attracted the leading end of the sheet 2 to the adjacent end face of the suction member 5. As the suction member 5 continues to move to its second position indicated by a phantom line III in FIG. 3 while holding the sheet 2 attracted thereto, its end face will overrun the leading edge of the sheet 2 to uncover the inlet opening 5*a*, whereby the atmosphere is admitted therethrough into the second chamber 20B of the cylinder, thereby causing a rapid displacement of the piston to the right. Thereupon, the quantity of air contained in the first chamber 20A is displaced therefrom through the piping 23 to nozzle 24, thus discharging through the discharge port 24*a*. The discharged air is directed or injected into the clearance between the drum 1 and the leading end of the sheet 2 which is separated therefrom during the movement of the suction member 5 from the position of phantom line II to the position of phantom line III shown in FIG. 3, thus contributing to a complete separation of the sheet 2 from the drum 1 (see FIG. 4). Subsequently as the drum 1 continues to rotate, the separated sheet 2 is guided by the guideplate 4 toward a secondary treatment apparatus.

As the first cam 10 further rotates, the roller 8 engages a larger diameter portion thereof, whereby the arms 6 rock clockwise, as viewed in FIG. 1, moving the center of rocking motion of the suction member 5 in a direction away from the drum. As a result, the free end of the member 5 moves along a path B shown in FIG. 2, and subsequently it follows a path C further removed from the drum under the action of lever 12 in returning to its initial position. When the single revolution clutch and hence the first cam 10 ceases to operate and stops, the roller 8 has just passed the transition from the larger to the small diameter portion of the first cam 10 as shown in FIG. 1, whereby the arms 6 rock counterclockwise as viewed in FIG. 1, moving the center of rocking motion of the member 5 toward the drum 1. Thus the free end of the member 5 follows a path D to return to its initial position. In the meantime, the second cam 13 has also rotated to its initial positions in which it returns the piston 18 to its initial position shown in FIG. 1.

What is claimed is:

1. A sheet separator for use in electrophotographic copying machines of the type comprising a rotating member for carrying copy sheets on the surface thereof, said separator comprising:

means disposed at a position adjacent the peripheral surface of said rotating member for separating a copy sheet from the surface when it is held attracted thereto, and having an air suction inlet formed in an end face which is located opposite the rotating member;

support shaft means for mounting said separating means for rotation between a first position in which the air suction inlet is located rearwardly, as viewed in the direction of rotation of the rotating member, of a line joining the axes of rotation of the rotating member, and the support shaft means, and a second position in which it is located forwardly of the line, said end face being located closest to the surface of the rotating member when aligned with the line;

air suction means communicating with the suction inlet for drawing air therethrough at least during a movement thereof from the position aligned with said line to the second position;

drive means for moving the separating means from the first to the second position as the leading end of the copy sheet which is held attracted to the surface of the rotating member approaches said line; and means for causing the velocity of movement of the end face of the separating means to exceed the peripheral speed of the rotating member.

2. A sheet separator for use in electrophotographic copying machines of the type comprising a rotating member for carrying copy sheets on the surface thereof, said separator comprising:

means disposed at a position adjacent the peripheral surface of said rotating member for separating a copy sheet from the surface when it is held attracted thereto, and having an air suction inlet formed in an end face which is located opposite the rotating member;

support shaft means for mounting said separating means for rotation between a first position in which the air suction inlet is located rearwardly, as viewed in the direction of rotation of the rotating member, of a line joining the axes of rotation of the rotating member, and the support shaft means, and a second position in which it is located forwardly of the line, said end face being located closest to the surface of the rotating member when aligned with the line;

air suction means comprising a piston and cylinder unit communicating with the suction inlet for drawing air therethrough at least during a movement thereof from the position aligned with said line to the second position; and drive means for moving the separating means from the first to the second position as the leading end of the copy sheet which is held attracted to the surface of the rotating member approaches said line.

3. A sheet separator for use in electrophotographic copying machines of the type comprising a rotating member for carrying copy sheets on the surface thereof, said separator comprising:

means disposed at a position adjacent the peripheral surface of said rotating member for separating a copy sheet from the surface when it is held attracted thereto, and having an air suction inlet formed in an end face which is located opposite the rotating member;

support shaft means for mounting said separating means for rotation between a first position in which the air suction inlet is located rearwardly, as viewed in the direction of rotation of the rotating member, of a line joining the axes of rotation of the rotating member, and the support shaft means, and a second position in which it is located forwardly of the line, said end face being located closest to the surface of the rotating member when aligned with the line;

air suction means communicating with the suction inlet for drawing air therethrough at least during a movement thereof from the position aligned with said line to the second position; and drive means including a cam which also drives said air suction means for moving the separating means from the first to the second position as the leading end of the copy sheet which is held attracted to the surface of the rotating member approaches said line.

4. A sheet separator or use in electrophotographic copying machines of the type comprising a rotating member for carrying copy sheets on the surface thereof, said separator comprising:

a suction means disposed at a position adjacent the peripheral surface of said rotating member for separating a copy sheet from the surface when it is held attracted thereto, and having an air suction inlet formed on an end face which is located opposite the rotating member;

support shaft means for mounting said suction means for rotation between a first position in which the air suction inlet is located rearwardly as viewed in the direction of rotation of the rotating member, of a line joining the axes of the rotating member and the support shaft, and a second position in which it is located forwardly of the line, said end face being located closest to the surface of the rotating member when aligned with the line;

means communicating with the suction means for drawing air from the interior thereof at least during its movement from the position aligned with the line to the second position;

drive means for moving the suction means from the first to the second position as the leading end of the copy sheet which is held attracted to the surface of the rotating member approaches said line;

a nozzle means for injecting a quantity of air into the clearance between the end face of the suction means and the surface of the rotating member at least during the movement of the suction means from the position aligned with the line to the second position; and means with which both the suction means and the nozzle means communicate for producing a suction/discharge action, and comprising a piston and cylinder unit, whereby the suction through the suction means and the discharge through the nozzle means takes place alternately by a reciprocatory motion of the piston.

5. A sheet separator for use in electrophotographic copying machines of the type comprising a rotating member for carrying copy sheets on the surface thereof, said separator comprising:

a suction means disposed at a position adjacent the peripheral surface of said rotating member for separating a copy sheet from the surface when it is held attracted thereto, and having an air suction inlet formed on an end face which is located opposite the rotating member;

support shaft means for mounting said suction means for rotation between a first position in which the air suction inlet is located rearwardly as viewed in the direction of rotation of the rotating member, of a line joining the axes of the rotating member and the support shaft, and a second position in which it is located forwardly of the line, said end face being located closest to the surface of the rotating member when aligned with the line;

means communicating with the suction means for drawing air from the interior thereof at least during its movement from the position aligned with the line to the second position;

drive means for moving the suction means from the first to the second position as the leading end of the copy sheet which is held attracted to the surface of the rotating member approaches said line;

a nozzle means for injecting a quantity of air into the clearance between the end face of the suction means and the surface of the rotating member at least during the movement of the suction means from the position aligned with the line to the second position; and means for causing the velocity of movement of the end face of the suction means to exceed the peripheral speed of the rotating member.

6. A sheet separator for use in electrophotographic copying machines of the type comprising a rotating member for carrying copy sheets on the surface thereof, said separator comprising:

a suction means disposed at a position adjacent the peripheral surface of said rotating member for separating a copy sheet from the surface when it is held attracted thereto, and having an air suction inlet formed on an end face which is located opposite the rotating member;

support shaft means for mounting said suction means for rotation between a first position in which the air suction inlet is located rearwardly as viewed in the direction of rotation of the rotating member, of a line joining the axes of the rotating member and the support shaft, and a second position in which it is located forwardly of the line, said end face being located closest to the surface of the rotating member when aligned with the line;

means communicating with the suction means for drawing air from the interior thereof at least during its movement from the position aligned with the line to the second position;

drive means for moving the suction means from the first to the second position as the leading end of the copy sheet which is held attracted to the surface of the rotating member approaches said line and comprising cam means for operating said air drawing means; and a nozzle means for injecting a quantity of air into the clearance between the end face of the suction means and the surface of the rotating member at least during the movement of the suction means from the position aligned with the line to the second position.

* * * * *